US006907894B1

(12) United States Patent
Bishop

(10) Patent No.: US 6,907,894 B1
(45) Date of Patent: Jun. 21, 2005

(54) COLLAPSIBLE PROTECTIVE SHELTER DEVICE HAVING DIELECTRIC AND FIRE-RESISTANT PROPERTIES

(76) Inventor: Ray Thomas Bishop, 16731 Wild Plum Cir., Morrison, CO (US) 80465

( * ) Notice: Subject to any disclaimer, the term of this patent is extended or adjusted under 35 U.S.C. 154(b) by 0 days.

(21) Appl. No.: 09/570,503

(22) Filed: May 13, 2000

(51) Int. Cl.[7] ..... A45B 3/00; E04H 15/54

(52) U.S. Cl. ..... 135/16; 135/98; 135/115; 135/33.2; 182/141

(58) Field of Search ..... 135/16, 33.2, 98, 135/90–91, 115, 20.1; 182/129, 141

(56) References Cited

U.S. PATENT DOCUMENTS 3,695,390 A * 10/1972 Leigh ..... 182/129
4,265,260 A * 5/1981 Gillis ..... 135/127
4,285,354 A * 8/1981 Beavers ..... 135/135
4,302,496 A * 11/1981 Donovan ..... 428/196
4,428,999 A * 1/1984 George et al. ..... 442/67
4,819,680 A * 4/1989 Beavers ..... 135/125
4,993,445 A * 2/1991 Dubinsky ..... 135/20.3
5,333,634 A * 8/1994 Taylor ..... 135/98
5,479,954 A * 1/1996 Lin ..... 135/98
5,678,587 A * 10/1997 Bilotti ..... 135/98
5,806,547 A * 9/1998 Derlinga ..... 135/33.2
6,209,556 B1 * 4/2001 Yu ..... 135/15.1
6,253,777 B1 * 7/2001 Anderson ..... 135/115

* cited by examiner

*Primary Examiner*—Winnie Yip
(74) *Attorney, Agent, or Firm*—John L. Isaac

(57) ABSTRACT

A dielectric, fire-resistant shelter apparatus is disclosed which affords temporary protection to individuals exposed to the open environment. The shelter apparatus includes a protective canopy which is movable between an open position for providing temporary cover and protection to individuals exposed to the environment and a closed, collapsed position for storage. The canopy is substantially dielectric and resistant to fire. A plurality of ribs interconnect with each other to support the canopy in its open position. Moreover, a plurality of struts are secured for supporting the ribs and canopy in the open position and for enabling the ribs and canopy to move to the closed collapsed position. Finally, at least one support element is provided for maintaining the relative positions of the struts, ribs and canopy when in the open position above a ground surface, the support element also being dielectric.

14 Claims, 4 Drawing Sheets

COLLAPSIBLE PROTECTIVE SHELTER DEVICE HAVING DIELECTRIC AND FIRE-RESISTANT PROPERTIES

BACKGROUND OF THE INVENTION

1. Field of the Invention

The present invention relates generally to collapsible shelter structures and, more particularly, to devices which provide temporary shelter to workers who are exposed to the environment. Specifically, the present invention relates to collapsible protective shelter devices which are both dielectric as well as fire-resistant to offer significant protection to workers who must work around high voltage electricity or in severe weather conditions.

2. Description of the Prior Art

Utility construction and repair workers must often work in rain, snow and hot sunny weather conditions, often without shelter or other protection from the environment. These working conditions can be on the ground surface or in utility lift buckets which are used to enable the work crews to access high wire connections or terminal boxes. Such working situations expose the workers to extreme environmental conditions which can be detrimental to the workers.

As a result, the present practice that is used to provide some environmental protection to such work crews is to employ a large but conventional, six-sided umbrella on a metal or wooden pole for protection from the elements. Such umbrella structures generally use a nylon or canvas canopy material held in place by metal ribs and other metal structural members which provide structural strength in harsh environmental conditions. Examples of typical general umbrella structures are illustrated in U.S. Pat. Nos. 3,692,035, 5,555,903 and 5,765,582. Alternatively, portable pop-up shelters similar to conventional tents for use on utility lift buckets or directly on the ground surface may also be used. These umbrellas or pop-up shelters generally provide sufficient shelter for a single person, although a work crew of two is somewhat cramped. To address the size problem, an alternate shelter assembly is suggested in U.S. Pat. No. 4,766,919 wherein several umbrella-type assemblies are secured together to provide a substantially larger size conventional environmental shelter for use on the ground surface.

Regardless of the size or shape of the shelters provided by the various prior art schemes, there is a definite deficiency in protection for the workers in certain working situations. Utility workers frequently work in severe weather situations where power has been interrupted by storms and the like. Such situations should include protection and shelter from not only the environment in general but also the presence of electricity in the form of lightning strikes or from high voltage sources. In the cases where utility workers must work out-of-doors during such severe thunderstorms, lightning strikes offer significant risk which has not yet been addressed by the prior art shelter devices. Moreover, such utility workers are constantly being exposed to high wire voltage sources. Finally, sparks and flying embers are a significant fire hazard to which utility workers are also exposed when working outside. Such sparks and embers can originate from lightning strikes, high wire shorts, residential or industrial fires, and the like. While prior shelter devices have been devised to provide general protection from the sun and the rain, there is still a need for protective shelter devices that not only provide such general environmental protection, but will also provide protection to workers from electrical sources and fire hazards.

SUMMARY OF THE INVENTION

Accordingly, it is one object of the present invention to provide a collapsible temporary shelter.

It is another object of the present invention to provide a protective cover device that is dielectric and affords protection from lightning and high voltage power lines.

Yet another object of the present invention is to provide a protective shelter that is also fire-resistant in the event of sparks or embers from high voltage wires or other sources.

Still another object of the present invention is to provide such a dielectric and fire-resistant protective shelter device that can be used in any number of varied working situations from utility lift buckets to use directly on the ground surface.

To achieve the foregoing and other objects and in accordance with the purpose of the present invention, as embodied and broadly described herein, a dielectric, fire-resistant shelter apparatus is disclosed. This shelter apparatus is designed to afford temporary protection to individuals exposed to the open environment. The shelter apparatus includes a protective canopy which is movable between an open position for providing temporary cover and protection to individuals exposed to the environment, and a closed collapsed position for storage. The canopy is substantially dielectric and resistant to fire. A plurality of ribs interconnect with each other to support the canopy in its open position. Moreover, a plurality of struts are secured for supporting the ribs and canopy in the open position and for enabling the ribs and canopy to move to the closed collapsed position. Finally, at least one support element is provided for maintaining the relative positions of the struts, ribs and canopy when in the open position above a ground surface, the support element also being dielectric.

In one preferred aspect of the invention, the ribs, struts and support element are all dielectric. Moreover, the canopy, which is both dielectric and fire-resistant, may be in the form of a single layer of flexible material which is both dielectric and fire-resistant, or it may be in the form of at least a double layer of flexible material having an outer layer of fire-resistant material and an inner layer of dielectric material. In a more preferred form, the canopy outer layer is siliconized rubber and the inner layer is woven fiberglass fabric.

In one preferred structure of the invention, the canopy is a tent-like structure sized and shaped for placement on a ground surface. This structure includes an upper cover portion which is maintained in an open spread-out position by the ribs, and a pair of side portions which depend from the cover portion and are secured thereto by the struts. The side portions are maintained in position on the ground surface by at least a pair of the support elements. Moreover, each side portion may be attached to the ribs and cover portion by a plurality of the struts and maintained in an upright position above the ground surface by a pair of the support elements.

In another structure of the invention, the canopy includes a cover member which is adapted for covering an industrial utility lift bucket. This structure of the invention includes a plurality of ribs which are adapted to maintain the cover member in an open, substantially flat condition. A plurality of struts are secured to hold the ribs in position, and a plurality of the support elements secure the ribs and struts to the bucket.

In yet another preferred structure of the invention, the protective canopy is in the form of an umbrella cover attached to the ribs. The apparatus further includes a hub member which is mounted on a single support element for longitudinal movement therealong. The hub member is secured to the struts for moving the umbrella cover between an open position, wherein the canopy is extended radially outwardly from the support element with the cover being supported by the ribs, and a closed position wherein the umbrella cover resides in a collapsed folded position substantially alongside the support element.

A further structure of the invention is in the form of a collapsible protective cover device offering temporary shelter to individuals while working in the outside environment. The device includes a flexible canopy covering which is movable between an open position wherein the canopy is expanded to provide temporary cover and protection to individuals exposed to the environment, and a closed, collapsed position for storage. The canopy covering is made from a material which is substantially dielectric and fire-resistant. A plurality of ribs are disposed to support and maintain the canopy covering in an open expanded position. In addition, a plurality of struts are secured to the ribs for supporting the canopy covering in its open position and are adapted to enable the ribs and canopy covering to move to a closed collapsed position. Finally, at least one base support element maintains the relative positions between the struts and ribs and the canopy covering when the canopy covering is in an open position above a ground surface. The base support element is made from a substantially dielectric material.

In still another structure of the invention, a foldable industrial umbrella is provided for use as a protective shelter for temporary protection by individuals working in the out-of-doors environment. The umbrella includes an elongate support element in the form of a pole having an upper end and a lower end. A flexible canopy sheet is movable between an open position wherein the canopy sheet is extended radially outwardly from proximate the upper end of the support element pole to provide temporary cover and protection to individuals exposed to the environment, and a closed, collapsed position folded substantially alongside the support element pole for storage. The canopy sheet is made from a material which is substantially dielectric and fire-resistant. A plurality of ribs are attached to the canopy sheet and disposed to support and maintain the canopy sheet in its open expanded position and in its closed folded position. A plurality of struts are secured to the ribs for supporting the canopy sheet in its open position and are adapted to move the ribs and canopy sheet to a closed collapsed position. Finally, the support element pole is made from dielectric material to electrically insulate the lower end of the support element pole from the struts, ribs and canopy sheet.

BRIEF DESCRIPTION OF THE DRAWINGS

The accompanying drawings which are incorporated in and form a part of the specification illustrate preferred embodiments of the present invention and, together with a description, serve to explain the principles of the invention. In the drawings.

DETAILED DESCRIPTION OF THE PREFERRED EMBODIMENTS

Figure 1:
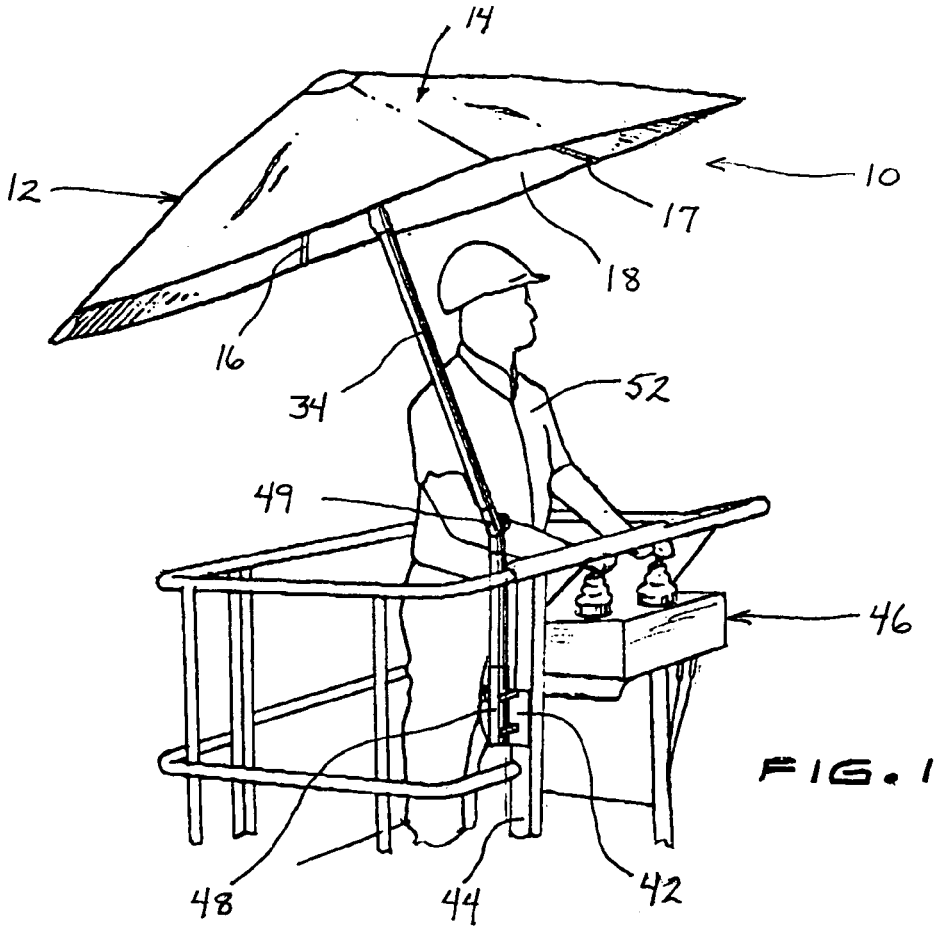
FIG. 1 is a front perspective view of one umbrella embodiment of the present invention installed onto a utility lift bucket and in its open position.
Figure 4:
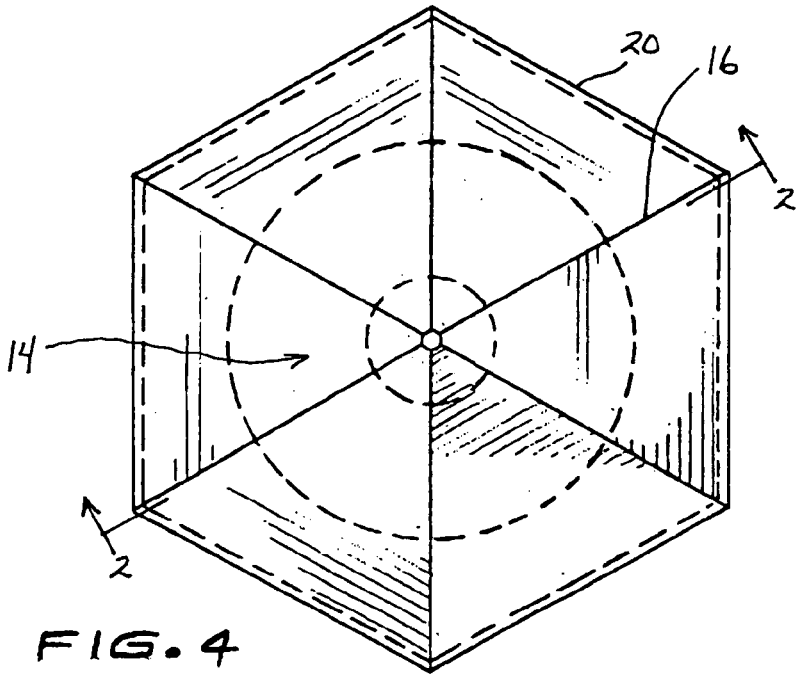
FIG. 4 is a top plan view of the umbrella embodiment illustrated in FIG. 1.
Figure 2:
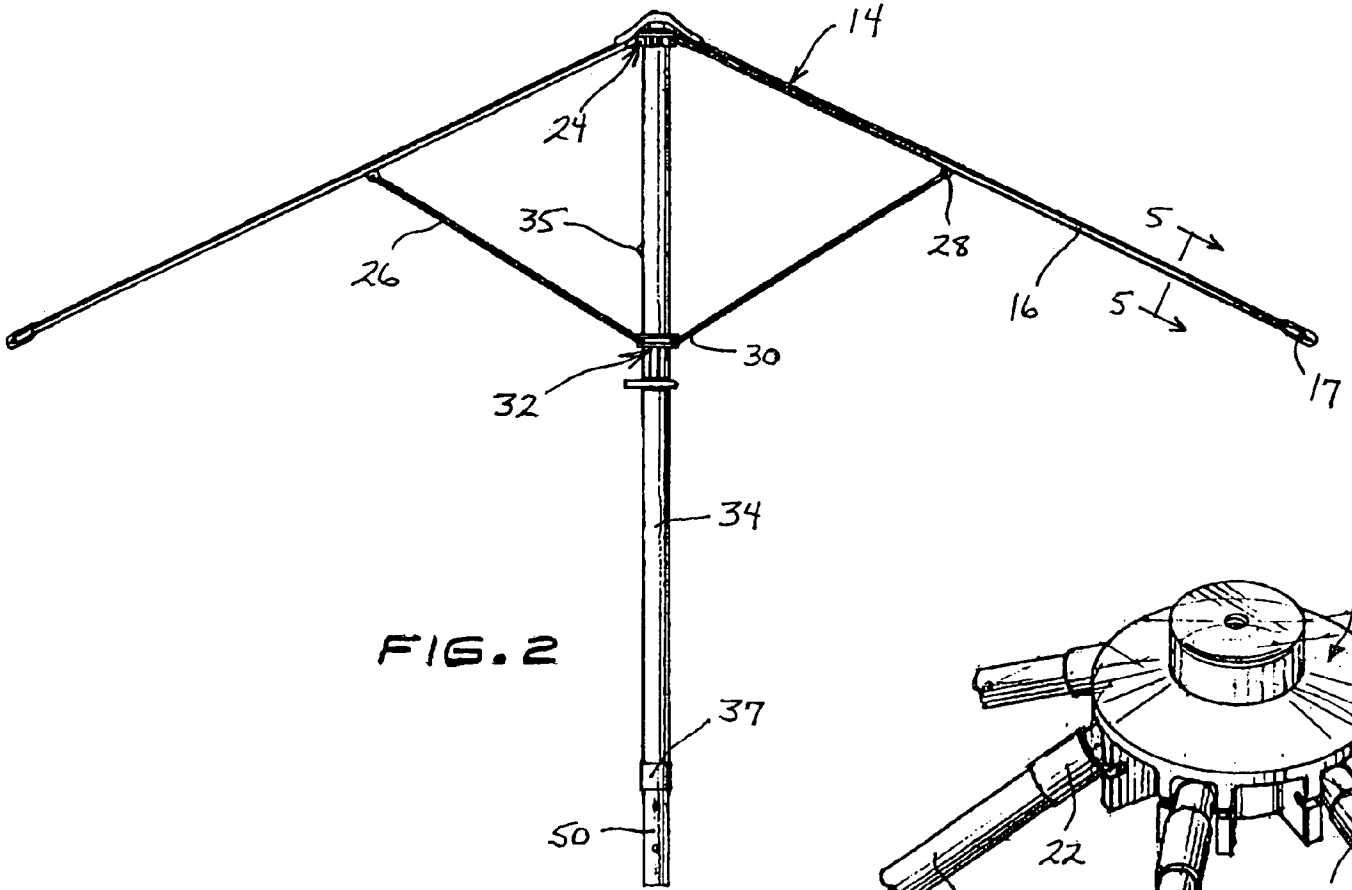
FIG. 2 is a side sectional view of the umbrella embodiment of FIG. 1 and taken substantially along line 2—2 of FIG. 4.
Figure 3:
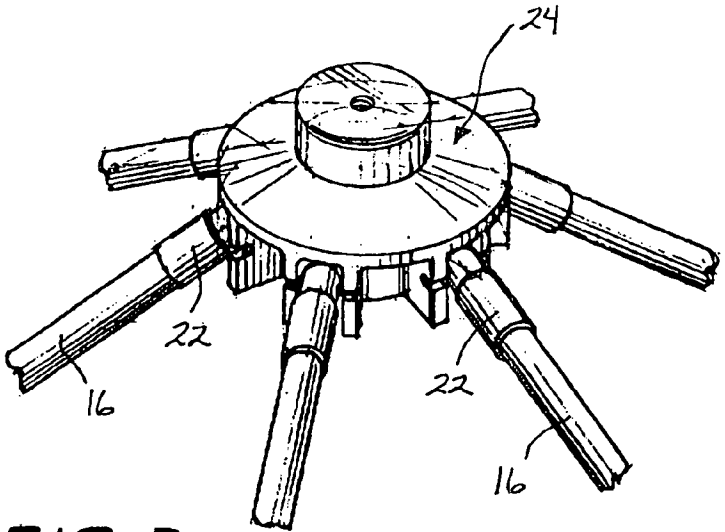
FIG. 3 is an enlarged perspective view of the hub member for attachment of the ribs of the umbrella embodiment illustrated in FIG. 2.

As previously described, the present invention is directed to a collapsible, protective shelter device which is primarily designed to provide temporary protection to people, and in particular utility workers, while they are working in the out-of-doors. Utility workers are particularly emphasized because they must work in the open environment under all sorts of good as well as bad weather conditions. However, it should be understood that the present invention may be used as a protective shelter or covering device for anyone under any type of circumstances. Moreover, the present invention is specifically designed to provide protection from electric shock and fire, two dangers that are very real in the lives of utility workers. Electric shock can come from touching a utility lift bucket or a protective umbrella or other shelter to a high voltage wire or from being struck by lightning during a storm. Fire can originate from sparks or embers arising from damaged high voltage wires, from lightning strikes, or from nearby structural fires. In any event, the device of the present invention not only offers protection from the typical environmental concerns such as rain, snow and hot sunny weather conditions, but even more importantly it offers protection from electric shock and fire.

Referring particularly now to FIGS. 1–5, a shelter apparatus 10 is illustrated. In one preferred form, the apparatus 10 is in the form of an umbrella 12 having a flexible covering member 14 which is adapted to provide the cover or shelter for the device 12. The protective cover member or canopy 14 is preferably a flexible material and is made from material which is both dielectric as well as fire-resistant as described in greater detail below. In this manner, should the cover member or sheet 14 come into contact with a high voltage wire or other electrical source, the cover sheet 14 will not conduct the electricity through the remaining portions of the device 12 and to a worker standing beneath the device 12 as described further below.

The umbrella cover sheet or canopy 14 is supported by a plurality of ribs 16 which are preferably arranged in a radially extending, fan-like manner along the underside 18 of the cover member 14. In this manner, the cover sheet 14, although flexible, is maintained in a fully extended position when the device 12 is in its open position as illustrated in FIGS. 1–4. In preferred form, the ribs 16 may be attached to the underside surface 18 of the cover sheet 14 in any known manner in the art. The ribs 16 are attached at their outer distal ends to the outer edge 20 of the cover member 14, while the inner ends 22 of the ribs 16 are secured to a central attachment bracket 24. The inner end 22 is preferably attached to the bracket 24 in a manner so that the ends 22 may pivot to enable the umbrella 12 to be moved between an open position and a closed position as described below. In preferred form, the ribs 16 and the bracket 24 are substantially nonconductive or dielectric, with the ribs 16 being made from wood, aluminum or fiberglass, and preferably fiberglass, while the bracket 24 is preferably made from a polycarbonate material.

A plurality of struts 26 are provided to control the movement of the ribs 16 and the cover member 14 when the device 12 is moved between its open position and its closed position. The outer distal end 28 of each strut 26 is preferably secured to a rib 16 at proximately the mid-portion of its length. The inner end 30 of each strut 26 is secured to a central hub 32 for movement therewith. In preferred form, the struts 26 and the central hub 32 are substantially nonconductive or dielectric, with the struts 26 being made from wood, aluminum or fiberglass, and preferably fiberglass, while the hub 32 is preferably made from a polycarbonate material similar to the bracket 24.

In preferred form, a support element 34 in the form of a pole is provided for supporting the umbrella device 12 is its desired position. The hub 32 is positioned to move along the length of the pole element 34, thereby moving the inner ends 30 of the struts 26 upwardly and downwardly along the length of the pole element 34. When the hub 32 is moved upwardly toward the attachment member 24, the outer ends 28 of the struts 26 are moved away from the pole element 34 and in turn push the ribs 16 and the cover member 14 away from the pole element 34 until the cover member 14 is substantially taut. The hub 32 is held in this open position by a release catch 35. Likewise, when the hub 32 is released from the catch 35 and moved downwardly along the pole element 34, the ribs 16 and the cover member 14 are folded in toward the pole element 34 until the ribs 16 and the struts 26 reside substantially alongside the pole element 34 for folding and storage. A stop member 37 limits the downward movement of the hub 32 along the pole 34. This is typical of general umbrella construction and behavior.

In preferred form, the support element or pole 34 is made from dielectric material so as to not to conduct electricity along its length. While any type of appropriate dielectric material may be used in the present invention, the preferred materials for the support element include wood, fiberglass or aluminum, which are strong yet electrically substantially nonconductive. More preferably, the support element 34 is made from fiberglass, which is virtually completely electrically nonconductive. Moreover, the struts 26 are likewise preferably dielectric and preferably made from fiberglass. In the more preferred form, the support element 34 and the struts 26 are both made from non-conducting fiberglass. In this manner, the primary support structure of the apparatus 10, i.e. the pole 34 and the struts 26, is preferably entirely dielectric and therefore electrically nonconductive. Furthermore, as previously mentioned, it is also preferred that the ribs 16 be made from dielectric material the same as that of the struts 26.

Figure 5:
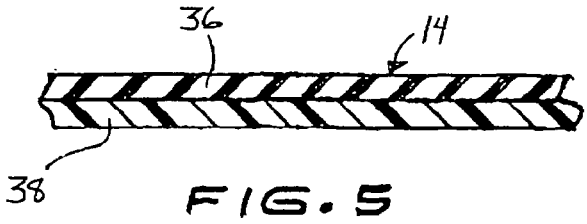
FIG. 5 is an enlarged cross-sectional view of one umbrella cover sheet embodiment of the invention as taken substantially along line 5—5 of FIG. 2.
Figure 6:
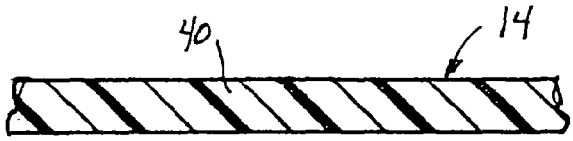
FIG. 6 is a cross-sectional view substantially similar to that illustrated in FIG. 5 but showing a one-layer cover sheet embodiment.

The cover sheet 14 of the device 12 is preferably both dielectric as well as fire-resistant. To accomplish this task, the cover sheet 14 is preferably made from appropriate materials. Referring particularly to FIGS. 5 and 6, the one embodiment of FIG. 5 illustrates two layers 36, 38 of material for the cover member 14. The outer layer 36 is preferably made from a fire resistant or retardant material such as siliconized rubber, although any type of appropriate fire-resistant fabric material known to the art may be used. The inner layer 38 is preferably made from an electrically nonconductive, dielectric fabric such as woven fiberglass, although any type of appropriate dielectric fabric material known to the art may be used. In this manner, the two materials will provide a synergistic effect of being both electrically nonconductive as well as resisting fire when exposed directly thereto. It should also be understood that the inner layer may be the fire-resistant layer while the outer layer may be the dielectric material. In an alternative from, a single layer 40 may be used as a cover sheet 14 provided the material 40 is a combination of a fire-resistant material which is also substantially dielectric. In this manner, should the cover sheet 14 come into contact with an electrical source, the electricity will not be passed therealong to the pole 34 and the workers 52 positioned beneath the device 12. Moreover, should sparks or embers strike the cover sheet 14, a fire will be prevented due to the fire resistant qualities of the cover member.

In the preferred structure of the invention, the two-layer form for the cover sheet 14 illustrated in FIG. 5 is preferred. In this embodiment, the material 36 is preferably siliconized rubber. More preferably, the material 36 is cured vinyl rubber which is layered or coated over a layer 38 of woven fiberglass fabric. One preferred source of this combination layered material is known as Aramatex SF7, a trademarked product distributed by Mid-Mountain Materials of Seattle, Wash. Another specific product which may be used in this capacity is No-MEX, a trademarked product of the 3M Company. An umbrella structure constructed in accordance with the invention described above was tested by Sturgeon Electric Company of Colorado. This test was performed on the structure of a wet umbrella device 12 using a Chance hot stick tester rated at 100,000 volts per foot. The results of these tests indicated that the structure of the invention did not conduct electricity therethrough and withstood any fire problems as well.

Referring to FIG. 1, the umbrella device 12 is preferably attached in one form to a receptacle 42 which is removably bolted to a leg 44 of a utility lift bucket 46. The receptacle 42 includes a tubular receiver 48 which is sized and shaped to removably receive either the lower end 50 (FIG. 2) of the support element or pole 34, or an extension 49 which in turn holds end 50. In this manner, the device 12 is firmly implaced during its use yet it can be readily removed when desired. Thus, an operator 52 of the bucket lift 46 is free to use his hands as necessary yet he is protected from the general elements of the environment such as rain, snow and sun. In addition, the operator 52 is protected from electric shock should any part of the umbrella device 12 come into contact with a high voltage wire or lightning. Finally, should the device 12 be exposed to sparks or embers, the device 12 will not only protect the operator 52 from being struck by these items, but it will also keep from being set afire due to its fire resistance.

Figure 7:
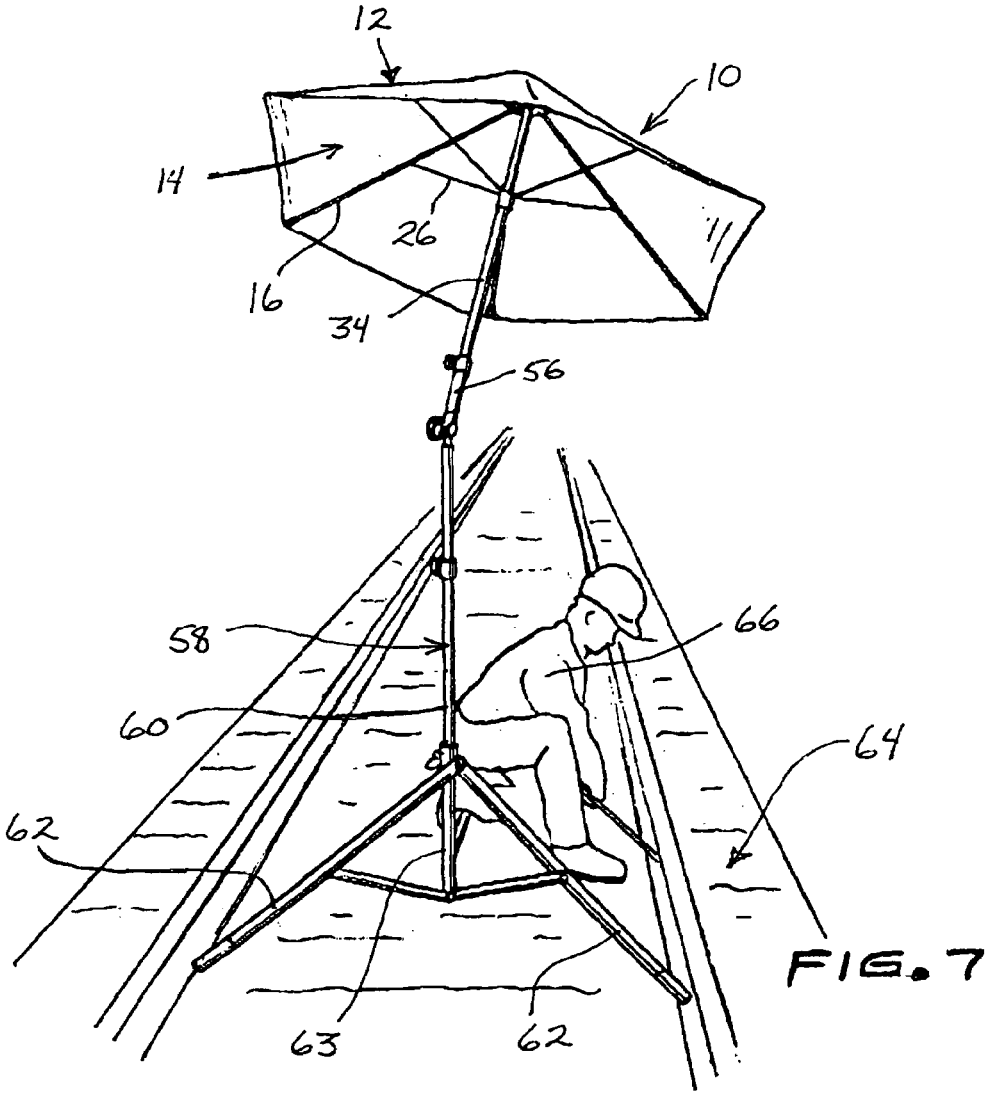
FIG. 7 is a front perspective view of another umbrella embodiment of the present invention installed for use on the ground surface.

Referring now to FIG. 7, an alternate embodiment for using the umbrella device 12 of FIG. 1 is illustrated. In this particular embodiment, the umbrella device 12 is as described in the previous FIGS. 1–5. However, the lower end 50 of the support element 34 is placed into a receptacle 56 which in turn is pivotally secured to a tripod device 58. The tripod device 58 preferably includes a length adjustable shaft member 60 and three collapsible tripod legs 62 extending from the lower end portion 63 of the shaft member 60. In this manner, the umbrella device 12 can be positioned on a ground surface 64 to provide environmental, electrical and fire protection to a worker 66 who must work on the ground as opposed to in the air in a utility bucket as in the prior embodiment.

Figure 8:
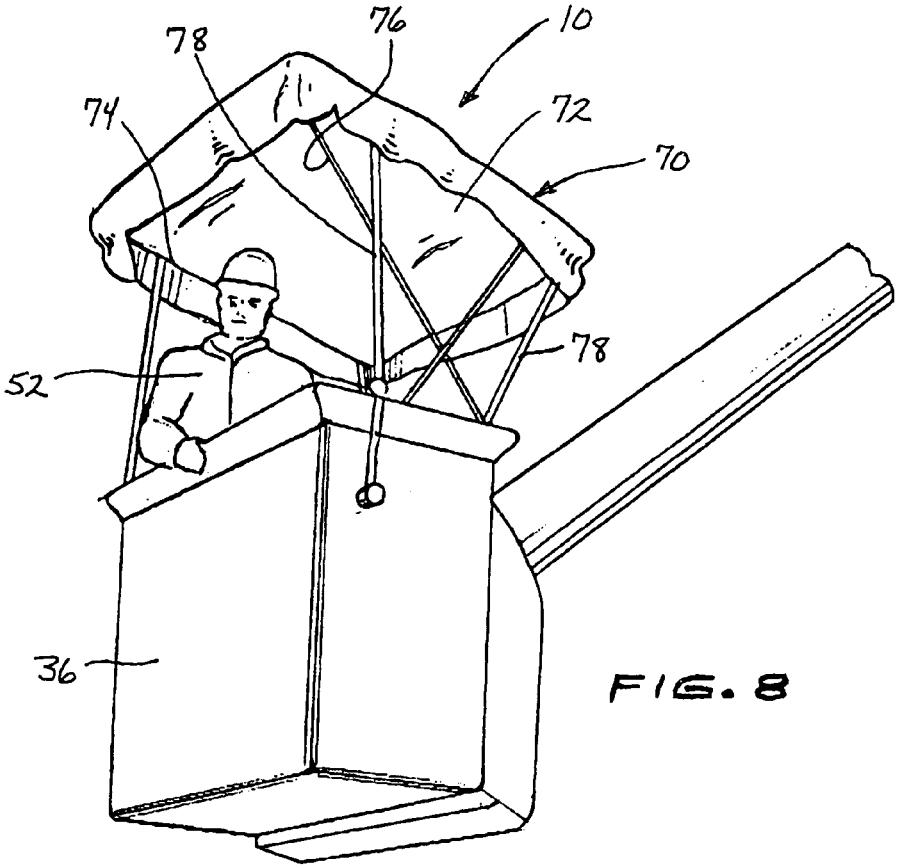
FIG. 8 is a perspective view of another cover device embodiment constructed in accordance with the present invention and illustrating its use on a utility lift bucket.

Referring now to FIG. 8, an alternate structure for the present invention is illustrated. In this embodiment, a shelter device 70 is provided for a utility lift bucket 36 as in the prior embodiment of FIG. 1. However, in this embodiment the device 70 includes a cover member or canopy 72 in the form of a substantially flat sheet made from the dielectric and fire-resistant material as previously described and specifically illustrated in FIGS. 5 and 6. The cover sheet 72 is maintained in its extended flat position over the bucket 36 and the worker 52 therein by a plurality of ribs 74 similar in construction and function to the ribs 16 of the previous embodiment. The ribs 74 are secured to the cover sheet 72 to hold it in its open position, and the ribs 74 are in turn maintained in place by a plurality of struts 76 similar to the struts 26 of the prior embodiment. The struts 76 are secured at one end to the ribs 74 and at their opposite ends, in turn, to a plurality of support elements 78. The support elements 78 are attached to the bucket 36 as illustrated. The support elements 78 are similar in material construction to the support element 34 of the previous embodiment in that the support elements 78 are preferably dielectric and made from fiberglass. Likewise, the struts 76 are preferably dielectric and made from the same material as the support elements 78, and the ribs 74 may also be made from the same dielectric material. In this manner, an alternate form of structure may be utilized to provide environmental protection to the worker 52 in the bucket 36 as well as electrical and fire resistant protection.

Figure 9:
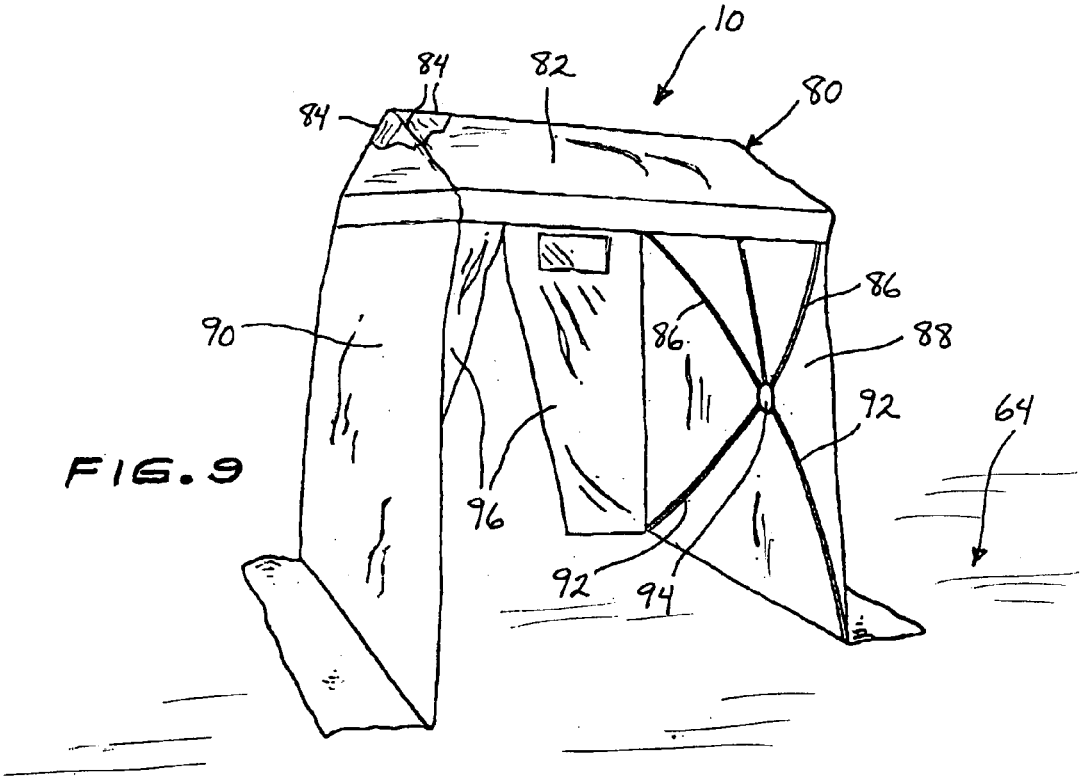
FIG. 9 is a perspective view of yet another embodiment of the invention constructed in the form of a tent-like structure for use on the ground surface.

Referring now to FIG. 9, a further embodiment of the invention is illustrated herein. In this embodiment, the dielectric and fire-resistant device 80 is in the form of a tent-like structure for placement on a ground surface 64. In this embodiment, the device 80 includes a cover portion or canopy 82 which is made from dielectric and fire-resistant material similar to the canopies 14 and 72 and as specifically illustrated in FIGS. 5 and 6. The cover portion 82 provides the primary protection for any worker positioned thereunder and is maintained in its spread-out or extended position by a plurality of ribs 84 placed under the edges of the cover portion 82. The ribs 84 are constructed similar to the ribs 16 and 74 of the prior embodiments, are attached to the cover portion 82, and serve in the same capacity of maintaining the cover portion 82 in its extended and open position. The ribs 84 are in turn attached to a plurality of struts 86 which, similar to the struts 26 and 78 of the prior embodiments, are preferably made from dielectric material such as fiberglass.

In this embodiment, the device 80 includes a pair of side portions 88, 90 which depend from the cover portion 82 and are secured to the ground surface 64. The side portions 88, 90 are preferably made from the same dielectric and fire-resistant material as the cover portion 82 and provide enhanced protection for individuals positioned within the device 80. The struts 86 assist in holding the side portions 88, 90 in position tautly beneath the cover portion 82. The struts 86 are in turn secured to a plurality of support elements 92 which attach the device 80 to the ground surface 64. In preferred form, the support elements 92 are similar to the support elements 34 and 78 of the prior embodiments in that they are preferably made from dielectric material such as fiberglass. In this manner, the electrical insulating capability of the device 80 is primarily provided by the cover portion 82, the side portions 88, 90, the struts 86 and the support elements 92. In one preferred form, each side portion 88, 90 is supported by a pair of support elements 92 foldably secured to the struts 86 with a connector device 94 of known design. Rear door flaps 96 and front door flaps (not illustrated) can also be incorporated into the design of this embodiment.

As can be seen from the above, utility workers frequently work in severe weather situations where power has been interrupted by storms, and the presence of electricity in the form of lightning strikes or from high voltage sources is an ever present danger. In the cases where utility workers must work out-of-doors during such severe thunderstorms, lightning strikes offer significant risk. Moreover, such utility workers are constantly being exposed to high wire voltage sources. In addition, sparks and embers are a significant fire hazard to which utility workers are also exposed when working outside in emergency situations. As can be seen, the present invention is a shelter device that provides workers, and in particular utility repair or construction workers, general protection from the environment such as from the sun, snow and rain. However, the present invention more importantly provides protection to workers from electrical sources and fire hazards due to the fact that it is dielectric and fire-resistant. As previously detailed, utility workers are frequently exposed to electrical and fire dangers while performing important repair or construction work, and the present invention not only provides environmental protection and comfort, but it also protects workers against exposure to such dangers. Finally, the present invention with its electrical and fire protection capabilities can be formed in a variety of structural configurations to permit its use on a utility lift bucket or on the ground surface in a number of different situations.

The foregoing description and the illustrative embodiments of the present invention have been described in detail in varying modifications and alternate embodiments. It should be understood, however, that the foregoing description of the present invention is exemplary only, and that the scope of the present invention is to be limited to the claims as interpreted in view of the prior art. Moreover, the invention illustratively disclosed herein suitably may be practiced in the absence of any element which is not specifically disclosed herein.

I claim:

1. A dielectric, fire-resistant shelter apparatus affording temporary protection to individuals exposed to the open environment and particularly vulnerable to electric shock and fire, said shelter apparatus comprising:

a protective canopy movable between an open position for providing temporary cover and protection to individuals exposed to the environment and a closed, collapsed position for storage, said canopy being a flexible material which is both substantially dielectric and resistant to fire and comprising at least a double layer of flexible material with an outer layer being a fire-resistant material and an inner layer being dielectric material;

a plurality of ribs interconnected to support said canopy in said open position;

a plurality of struts secured for supporting said ribs and canopy in said open position and for enabling said ribs and canopy to move to said closed collapsed position; and at least one support element for maintaining the relative positions of said struts, ribs and canopy when in said open position above a ground surface, said ribs, struts and support element being made of dielectric material.

2. The apparatus as claimed in claim 1, wherein said outer layer comprises siliconized rubber, and said inner layer comprises woven fiberglass.

3. The apparatus as claimed in claim 1, wherein said shelter apparatus comprises a tent-like structure sized and shaped for placement on a ground surface, and wherein said canopy further comprises an upper canopy portion maintained in an open spread-out position by said ribs, and a pair of side canopy portions depending from said upper canopy portion and secured thereto by said struts, said side canopy portions being maintained in position on the ground surface by at least a pair of said support elements.

4. The apparatus as claimed in claim 3, wherein each said side canopy portion is secured to said ribs and upper canopy portion by a plurality of said struts and maintained in an upright position above the ground surface by a pair of said support elements.

5. The apparatus as claimed in claim 1, wherein said protective canopy comprises an umbrella cover attached to said ribs, and wherein said apparatus further comprises a hub member mounted on said support element for longitudinal movement therealong, said hub member being secured to said struts for moving said umbrella cover between an open position wherein said canopy is extended radially outwardly from said support element with the cover being supported by said ribs, and a closed position wherein said umbrella cover resides in a collapsed folded position substantially alongside said support element.

6. A collapsible protective cover device offering temporary shelter to individuals vulnerable to electric shock and fire while working in the outside environment, said device comprising:

a flexible canopy covering movable between an open position wherein said canopy is expanded to providing temporary cover and protection to individuals exposed to the environment, and a closed, collapsed position for storage, said canopy covering being made from a material which is substantially dielectric and fire-resistant and which comprises an outer layer of fire-resistant material and an inner layer of dielectric material;

a plurality of ribs constructed from substantially dielectric material and secured to support and maintain said canopy covering in an open expanded position;

a plurality of struts constructed from substantially dielectric material and secured to said ribs for supporting said canopy covering in its open position and adapted to enable said ribs and canopy covering to move to a closed collapsed position; and at least one base support element for maintaining the relative positions between said struts and ribs and said canopy covering when said canopy covering is in an open position above a ground surface, said base support element being made from a substantially dielectric material.

7. The device as claimed in claim 6, wherein said dielectric material for said base support element, said ribs and said struts is selected from the group consisting of wood, fiberglass and aluminum.

8. The device as claimed in claim 6, wherein said protective cover device comprises a tent-like structure sized and shaped for placement on a ground surface, and wherein said canopy covering comprises an upper canopy portion maintained in an open extended position by said ribs, and a pair of side canopy portions depending from said upper canopy portion, each said side canopy portion being secured to said ribs by a plurality of said struts and maintained in an upright position relative to the ground surface by at least a pair of said base support elements.

9. The device as claimed in claim 6, wherein said flexible canopy covering comprises an umbrella cover attached to said ribs, and wherein said apparatus comprises one said support element and a hub made from substantially dielectric material mounted thereon for longitudinal movement along the length of said support element, said hub being secured to said struts for moving said umbrella cover between an open position wherein said canopy covering is extended radially outwardly from said support element with the cover being supported by said ribs, and a closed position wherein said umbrella cover resides in a collapsed folded position substantially alongside said support element.

10. A foldable industrial umbrella usable as a protective shelter for temporary protection by individuals working in the out-of-doors environment subject to electric shock and fire exposure, said umbrella comprising:

an elongate support element in the form of a pole having an upper end and a lower end and made from dielectric material;

a flexible canopy sheet movable between an open position wherein said canopy sheet is extended radially outwardly from proximate the upper end of said support element to provide temporary cover and protection to individuals exposed to the environment, and a closed, collapsed position folded substantially alongside said support element for storage, said canopy sheet being made from a material which is substantially dielectric as well as fire-resistant and which comprises an outer layer of fire-resistant material and an inner layer of dielectric material;

a plurality of substantially dielectric ribs attached to said canopy sheet and disposed to support and maintain said canopy sheet in said open expanded position and in said closed folded position;

a plurality of substantially dielectric struts secured to said ribs for supporting said canopy sheet in its open position and adapted to move said ribs and canopy sheet to a closed collapsed position; and said dielectric support element, ribs, struts and canopy electrically insulating a user of said umbrella from electric shock.

11. The umbrella as claimed in claim 10, wherein said umbrella further includes a hub member disposed for movement along the length of said support element, said struts being connected to said hub member for movement between said open and closed positions.

12. The apparatus as claimed in claim 11, wherein said canopy sheet comprises an outer layer of siliconized rubber disposed over an inner layer of woven fiberglass.

13. The umbrella as claimed in claim 10, wherein the dielectric material for said ribs, struts and support element is selected from the group consisting of wood, fiberglass and aluminum.

14. The umbrella as claimed in claim 13, wherein the dielectric material for said ribs, struts and support element is fiberglass.

* * * * *